US007389973B1

(12) United States Patent
Chou et al.

(10) Patent No.: US 7,389,973 B1
(45) Date of Patent: Jun. 24, 2008

(54) TENSIONING SYSTEMS AND METHODS FOR LINE SPOOLING

(75) Inventors: Chia-Te Chou, Bellingham, WA (US); Jonathan D. Miller, Lafayette, LA (US)

(73) Assignee: Samson Rope Technologies, Ferndale, WA (US)

( * ) Notice: Subject to any disclaimer, the term of this patent is extended or adjusted under 35 U.S.C. 154(b) by 0 days.

(21) Appl. No.: 11/706,452

(22) Filed: Feb. 15, 2007

(51) Int. Cl.
*B66D 1/00* (2006.01)

(52) U.S. Cl. ..... 254/277; 254/327; 254/337; 254/338; 254/392; 254/393

(58) Field of Classification Search ..... 254/327, 254/335, 336, 337, 338, 275, 277, 272, 392, 254/393, 396, 398
See application file for complete search history.

(56) References Cited

U.S. PATENT DOCUMENTS

| | | | | |
|---|---|---|---|---|
| 3,707,922 | A * | 1/1973 | Dillon | 104/114 |
| 3,713,548 | A * | 1/1973 | Hanke | 414/138.3 |
| 3,785,511 | A * | 1/1974 | Bonnamy et al. | 414/139.7 |
| 3,791,628 | A * | 2/1974 | Burns et al. | 254/277 |
| 3,871,527 | A * | 3/1975 | Schimmeyer et al. | 212/308 |
| 4,638,978 | A * | 1/1987 | Jordan | 254/228 |
| 4,759,256 | A * | 7/1988 | Kovit et al. | 91/29 |
| 5,863,368 | A * | 1/1999 | Perrin | 156/177 |
| 6,856,850 | B2 * | 2/2005 | Rajala et al. | 700/122 |
| 6,926,260 | B1 * | 8/2005 | De Groot et al. | 254/277 |
| 2003/0052148 | A1 * | 3/2003 | Rajala et al. | 226/44 |

FOREIGN PATENT DOCUMENTS

| | | | |
|---|---|---|---|
| GB | 2026421 | A * | 2/1980 |
| GB | 2066762 | A * | 7/1981 |
| JP | 53114149 | A * | 10/1978 |
| JP | 06127892 | A * | 5/1994 |

OTHER PUBLICATIONS

Statoil, ASA, "Deepwater installation using synthetic fibre rope deployment systems", Milestones 2006, Mar. 31, 2007, pp.19-20, http://statoil.no/statoilcom/technology/svg03268.nsf/Attachments/Milestones+2006/$FILE/Milestones%202006.pdf.

(Continued)

*Primary Examiner*—Emmanuel M Marcelo
(74) *Attorney, Agent, or Firm*—Michael R. Schacht; Schacht Law Office, Inc.

(57) ABSTRACT

A line tensioning system for regulating tension on a line having a proximal end and a distal end, where the proximal end is operatively connected to a drum. The line tensioning system comprises a frame, a first and second sets of rollers, and first and second sets of displacement assemblies. The frame defines first and second side edges. Each first and second displacement assembly is arranged to displace at least one of the first and second rollers relative to the first and second side edges of the frame, respectively. The line is arranged such that the line contacts the first and second rollers. The first and second displacement assemblies displace the first and second rollers relative to the first and second edges based on a tension on the line.

20 Claims, 7 Drawing Sheets

OTHER PUBLICATIONS

Odim Alitec of Norway, "Full scale inshore test of the Fibre Rope Deployment System (FRDS); CTCU", May-Aug. 2004, 1 page, http://www.demo2000.no/files/96305d9_odim.pdf.

Odim Alitec of Norway, "Presentation CTCU System, Fibre Rope Deployment System (FRDS) ODIM CTCU — Cable Traction Control Unit", 2000, 17 pages, http://www.demo2000.no/filearchive/pdf/odim_sverre_torben.pdf.

Offshore Shipping Online, "ODIM secures breakthrough contract for fibre rope winch", Feb. 20, 2006, 4 pages, http://www.oilpubs.com/oso/article.asp?vl=5086.

Norske Shell, "New offshore oil and gas fields are increasingly using more subsea hardware, especially in ultra deep waters", 2000, 1 page, http://www.shell.com/home/content/no-no/shell_for_business/exploration_production/stn/stn_odim_winch.html.

Rigzone.com, "Odim Receives Good Report Card for CTCU-based Fiber Rope System", Oct. 25, 2006, 3 pages, http://www.rigzone.com/news/article.asp?a_id=37434.

TMC Net, "Norway's ODIM ASA wins breakthrough contract for its CTCU deepwater winch technology", Aug. 9, 2007, 5 pages, http://www.tmcnet.com/usubmit/2007/08/09/2850147.htm.

Penn Energy Jobs Petroleum Virtual Job Fair, "Synthetic rope, new winch system allow deeper subsea deployment", May, 2005, 3 pages, http://www.offshore-mag.com/Zrticles/Article_Display.cfm?Article_ID=227690.

Pennwell Classifieds, "Fiber rope system scores heavily over wire for deepwater installations", April, 2007, 3 pages, http://www.offshore-mag.com/display_article/290847/9/ARCH/noneFiber-rope-system-scores-heavily-over-wire-for-deepwater-installations/.

Odim Alitec of Norway, "Presentation of ODIM", Feb.,2004, 17 pages, http://www.innovasjonnorge.no/upload/JogeirRomestrand-Odim.pdf.

OE '06 Show Daily, "Making Connections", May, 2, 2006, p. 13, http://www.otcnet.org/2006/pdf/otc_sd_tuesday_lt.pdf.

Odim Alitec of Norway, "Demo 2000 Project", Jan. 23, 2007, pp. 6-14, http://www.offshore.no/ptc/prog07/Per%20Ingeberg.pdf.

The Patent Office, "The Patents and Designs Journal", Oct. 27, 1999, p. 31, http://www.ipo.gov.uk/patent/p-journal/p-pdj/1999-5764.pdf.

Honeywell Performance Products, "Fiber Rope Deployment System for Deep Water Heavy Lifting", Oil & Gas Journal Online: Oil and das Industry & Petroleum News Covering Oil Drilling . . . , Sep. 2004, p. 3, http://www.ogj.com/productlocator/showcase_cat_browse.cfm?cat=125099&TimePeriod=.

U.S. Coast Guard, "160.115 - Lifeboat and Rescue Boat Winches (SOLAS)/ Welin Lambie Limited", U.S. Coast Guard Equipment List, May 9, 2002, p.4, http://www.uscg.mil/gq/g-m/mse/equiplists/160115.pdf.

U.S. Coast Guard, "160.132 - Davits for Lifeboats and Rescue Boats (SOLAS)/ Caley Ocean Systems", U.S. Coast Guard Equipment List, May 2, 2002, p. 1, http://www.uscg.mil/gq/g-m/mse/equiplists/160132.pdf.

Rexroth Bosch Group, "Downloads, MAHCS 3D Animation", Website http://www.boschrexroth.com/business_units/bri/subwebsites/systems_engineering/en/Animations/Trailer_MAHCS/index.jsp, Jan. 11, 2008, 1 page.

Rexroth Bosch Group, "Offshore Technology Heave Compensation", Website http://www.boschrexroth.com/business_units/bri/subwebsites/systems_engineering/en/Industry_Segments/Offshore_Technology/applications_offshore/appl-heave/index.jsp;jsessionid=caVVP9HoNWv8HnKvlv, Jan. 11, 2008, 1 page.

Rexroth Bosch Group, "Bosch Rexroth introduces a new generation of rotating Active Heave Compensators", Website http://www.boschrexroth.com/country_units/america/united_states/en/news_and_press/press_releases/bri/2007_OTC_AHC/index.jsp, Apr. 25, 2007, 1 page.

Odim SPectrum Limited, "Compliant Linear Traction Drive (CLTD) for Cable & Towed Array Handling Systems", Website http://www.odim-spectrum.com/cltd.html, 2005, pp. 1-3.

Odim Spectrum Limited, "Compliant Linear Traction Drive (CLTD)", Website http://www.odim-spectrum.com/cltd2.html, 2005, pp. 1-3.

Odim Spectrum Limited, "Comliant Linear Traction Drive (CLTD) product Data & Specifications", Website http://www.odim-spectrum.com/cltd3.html, 2005, pp. 1-2.

* cited by examiner

TENSIONING SYSTEMS AND METHODS FOR LINE SPOOLING

TECHNICAL FIELD

The present invention relates to deck hardware and, in particular, to tensioning systems that facilitate the spooling of line in a marine environment.

BACKGROUND OF THE INVENTION

When performing subsea operations, a payload is often released at depth. The payload is attached to a line. As the payload is lowered into the sea, the line is unwound from a drum. After the payload is released, the line must be retrieved by winding the line back onto the drum. Spooling the line back onto drum with little or no load is problematic, especially when the line is again loaded with another payload and more tension is applied to the line wound onto the drum under little or no tension.

The need thus exists for tensioning systems and methods for line spooling that allow line to be extended under load and retrieved under little or no load.

SUMMARY OF THE INVENTION

The present invention may be embodied as a line tensioning system for regulating tension on a line having a proximal end and a distal end, where the proximal end is operatively connected to a drum. The line tensioning system comprises a frame, a first and second sets of rollers, and first and second sets of displacement assemblies. The frame defines first and second side edges. Each first and second displacement assembly is arranged to displace at least one of the first and second rollers relative to the first and second side edges of the frame, respectively. The line is arranged such that the line contacts the first and second rollers. The first and second displacement assemblies displace the first and second rollers relative to the first and second edges based on a tension on the line. The present invention may also be embodied as a system for placing a payload having such a tensioning system.

The present invention may also be embodied as a method of regulating tension on a line having a proximal end and a distal end, where the proximal end is operatively connected to a drum. The method comprises the following steps. At least one first roller is displaced relative to a first side edge of a frame. At least one second roller is displaced relative to a second side edge of the frame. The line is arranged such that the line contacts the first and second rollers. The first and second displacement assemblies are operated to displace the first and second rollers relative to the first and second edges based on a tension on the line.

DETAILED DESCRIPTION OF THE INVENTION

Figure 1A:
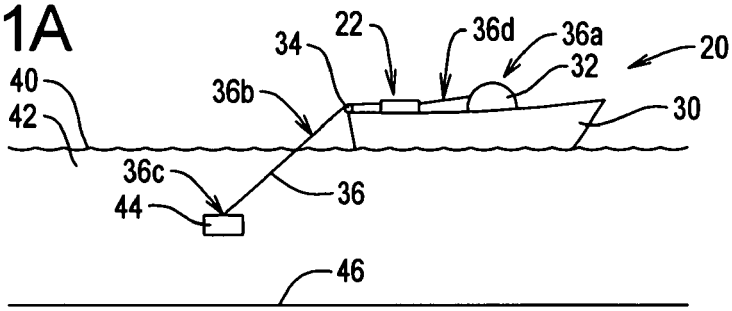
FIGS. 1A-1D depict the process of extending line out, releasing a payload, and retrieving the line using a line tensioning system of the present invention.

Referring initially to FIGS. 1A-1D of the drawing, depicted at 20 therein is a payload placing system employing a line tensioning system 22 constructed in accordance with, and embodying, the principles of the present invention. The payload placing system 20 further comprises a platform 30, a drum 32, a payout roller 34, and a line 36. The platform 30 is designed to float on the surface 40 of a body of water 42. The example payload placing system 20 is configured to arrange a payload 44 on the floor 46 of the body of water 42.

Figure 1B:
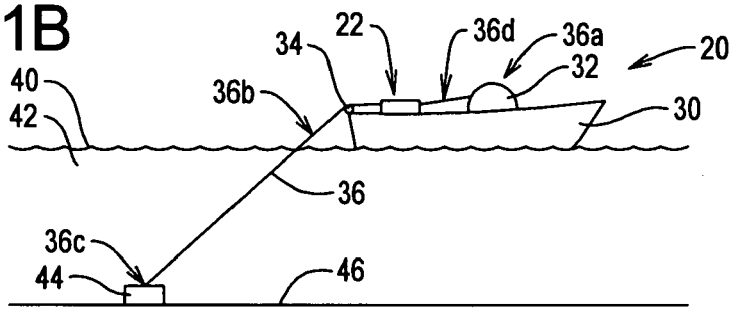
Figure 1C:
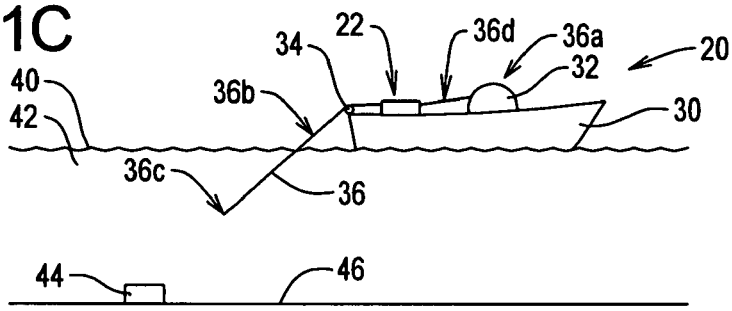

In particular, a proximal end 36*a* of the line 36 is initially wound around the drum 32. An intermediate portion 36*b* of the line 36 is unwound from the drum 32 and passed through the line tensioning system 22 and over the payout roller 34. The payload 44 is then attached to a distal end 36*c* of the line 36. The payload 44 is then lowered into the water 42, as shown in FIG. 1A, and the line 36 is spooled out from the drum 32 until the payload 44 reaches its desired destination, in this case the floor 46 of the body of water 42 (FIG. 1B). After the payload 44 reaches its desired destination, the payload 44 is detached from the distal end 36*c* of the line 36 such that the distal end 36*c* of the line 36 is free as shown in FIG. 1C.

Figure 1D:
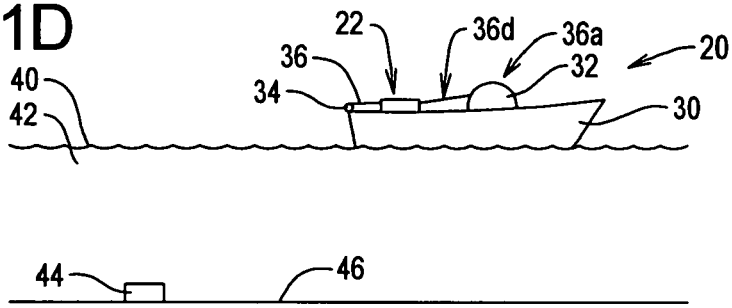

After the payload 44 is detached from the line 36, the intermediate portion 36*b* of the line 36 is under little or no tension from the tensioning system 22 to the distal end 36*c*. However, the tensioning system 22 engages the line 36 such that a regulated portion 36*d* of the line 36 between the tensioning system 22 and the drum 32 is under tension. Accordingly, as the line 36 is spooled onto the drum 32, the tensioning system 22 engages the line 36 to ensure that the line 36 is properly wound onto the drum 32 as the entire line 36 is retrieved as shown in FIG. 1D. The line 36 is thus ready for the next time that the placing system 20 is used to place another payload.

Figure 2:
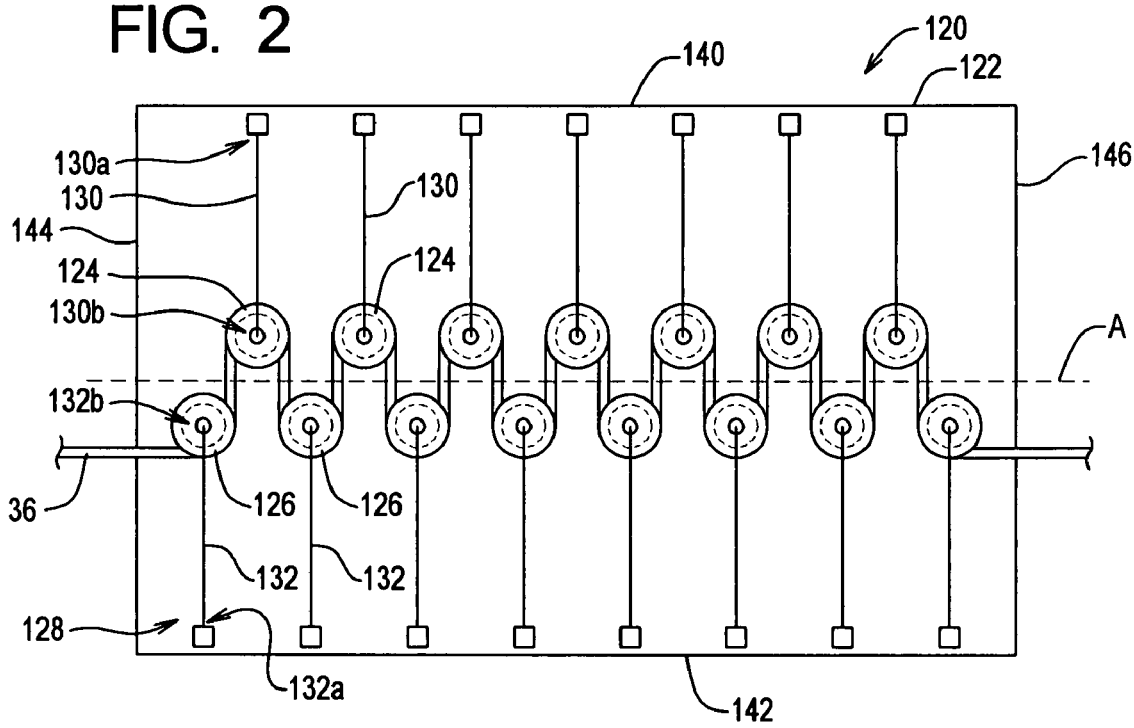
FIGS. 2 and 3 are top plan views of a first example line tensioning system of the present invention.
Figure 3:
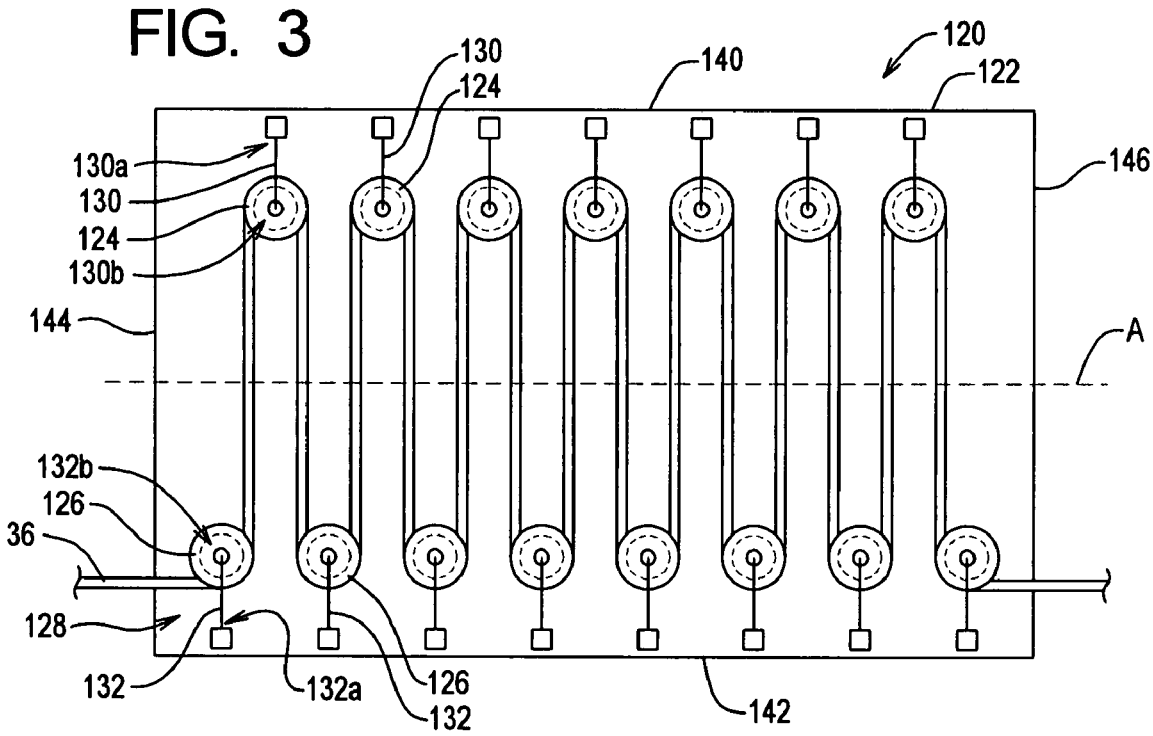

Referring now to FIGS. 2 and 3, depicted therein is a first example tensioning system 120 that may be used as the tensioning system 22 described above. The example tensioning system 120 comprises a frame 122, a first set of tensioning rollers 124, a second set of tensioning rollers 126, and a roller displacement system 128.

The roller displacement system 128 comprises a first set of displacement assemblies 130 and a second set of displacement assemblies 132. Each of the displacement assemblies is connected between the frame 122 and one of the tensioning rollers 124 or 126.

In particular, the frame 122 comprises a first side edge portion 140, a second side edge portion 142, a first end edge portion 144, and a second end edge portion 146. The example tensioning system 120 defines a main axis A extending between the first and second end edge portions 144 and 146; the example main axis A is spaced parallel to and equidistant from the side edge portions 140 and 142.

A proximal end 130*a* of each of the first displacement assemblies 130 is connected to the first side edge portion 140. A proximal end 132*a* of each of the second displacement assemblies 132 is similarly connected to the second side edge portion 142. The distal ends 130*b* of the first displacement assemblies 130 are connected to a corresponding one of the first tensioning rollers 124, while the distal ends 132*b* of the second displacement assemblies 132 are connected to a corresponding one of the second tensioning rollers 126.

The first displacement assemblies 130 are configured to displace the first tensioning rollers 124 towards and away from the first side edge portion 140. The second displacement assemblies 132 are similarly configured to displace the second tensioning rollers 126 towards and away from the second side edge portion 142. In addition, the first and second displacement assemblies 130 and 132 and the tensioning rollers 124 and 126 are offset from each other along the main axis A.

In use, the line 36 is arranged generally along the main axis A to extend along outer portions of the first and second tensioning rollers 124 and 126. Effective lengths of the displacement assemblies 130 and 132 change as necessary to maintain any portion of the line 36 between the tensioning device 120 and the drum 32 at a predetermined tension load or within a desired range of tension loads.

The example first and second tensioning rollers 124 and 126 move between first positions adjacent to the main axis A and second positions adjacent to the edge portions 140 and 142, respectively. As will be explained in further detail below, the effective lengths of the displacement assemblies 130 and 132 may be changed to move the tensioning rollers 124 and 126 between the first and second positions using passive and/or active control systems.

Figure 4:
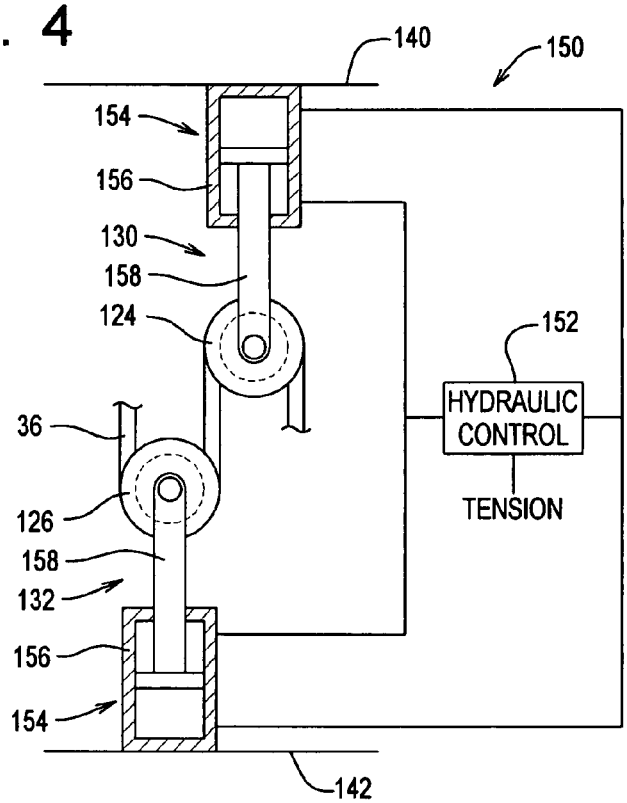
FIGS. 4 and 5 are schematic views of example displacement assemblies that may be used by a line tensioning system of the present invention.

Referring now to FIG. 4 of the drawing, depicted therein is an example active control system 150 configured to displace the tensioning rollers 124 and 126 towards or away from the respective side edge portions 140 and 142 in response to a TENSION signal indicative of the tension on the line 36. The example active control system 150 comprises, in addition to the displacement assemblies 130 and 132, a hydraulic control system 152. The displacement assemblies 130 and 132 each comprise a hydraulic actuator assembly 154 comprising a housing 156 and a shaft 158. The hydraulic control system 152 is configured to move the shafts 158 relative to the housings 156 based on the TENSION signal to displace the tensioning rollers 124 and 126 as necessary to control the tension on the line 36.

Figure 5:
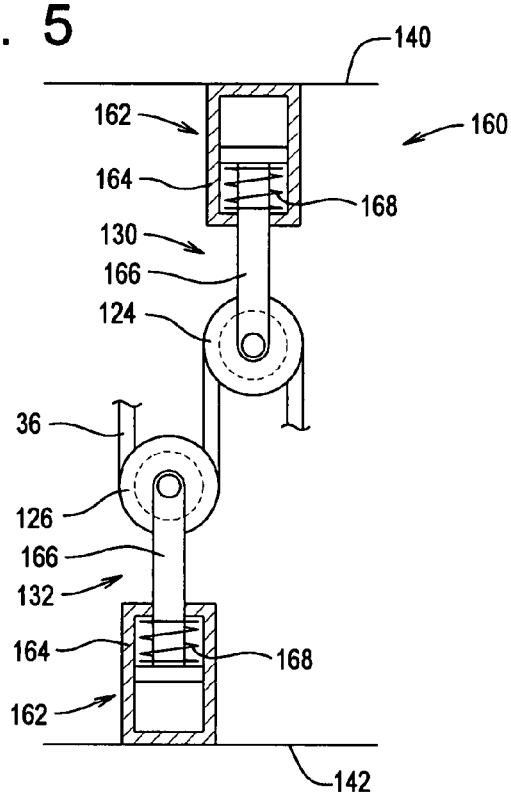

A passive control system 160 as depicted in FIG. 5 may be configured to control the location of the tensioning rollers 124 and 126 relative to the main axis A depending upon the tension on the line 36. As shown in FIG. 5, the example passive control system 160 comprises a plurality of spring assemblies 162 that form the displacement assemblies 130 and 132. The spring assemblies 162 each comprise a housing 164, a shaft 166, and a spring member 168. The spring member 168 is configured to compress and expand based on the tension on the line 36 to displace the tensioning rollers 124 and 126 as necessary to control the tension on the line 36. If the tension on the line 36 drops, the spring members 168 expand, retracting the shafts 166 and displacing the tensioning rollers 124 and 126 to create a more tortuous path that takes up slack in the line 36. Increasing tension on the line 36 will compress the spring members 168 to move the tensioning rollers 124 and 126 away from the side edge portions 140 and 142.

In addition, a tension device 120 of the present invention may be implemented using both active control and passive control. The springs of a passive control system will also function to absorb shocks within a certain predetermined range of loads. Both passive and combination control systems may be damped with an appropriate damping mechanism.

Figure 6:
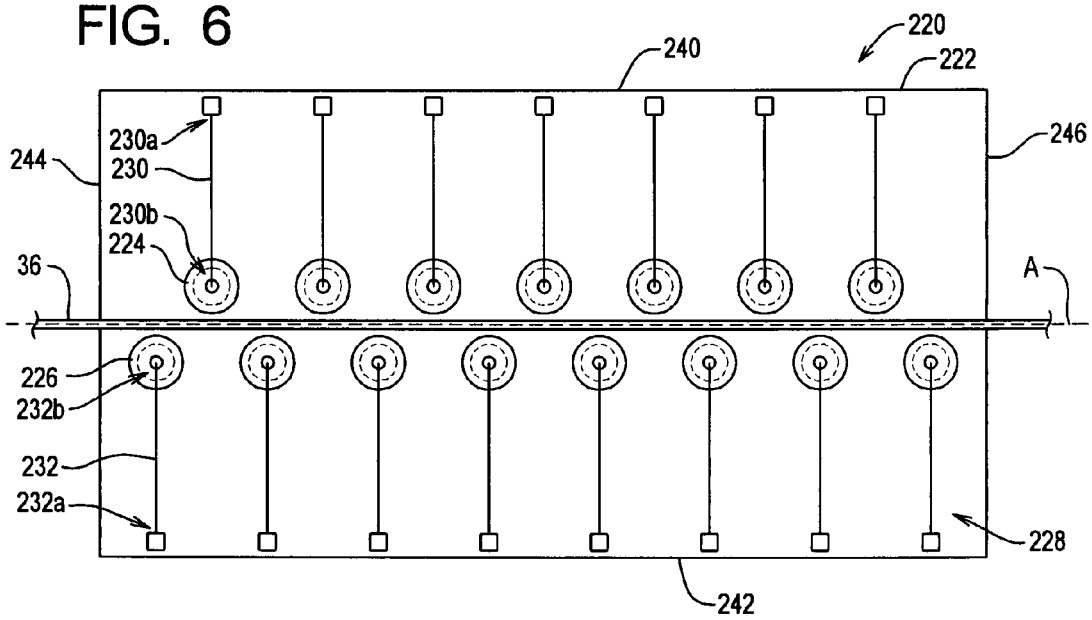
FIGS. 6-8 are top plan views of a second example line tensioning system of the present invention.
Figure 7:
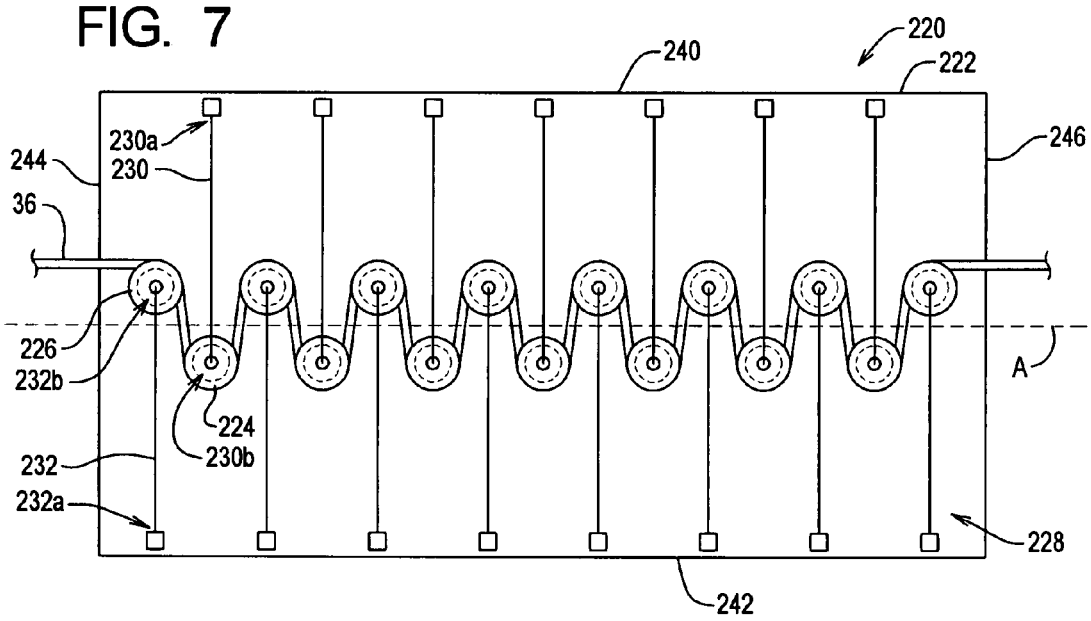
Figure 8:
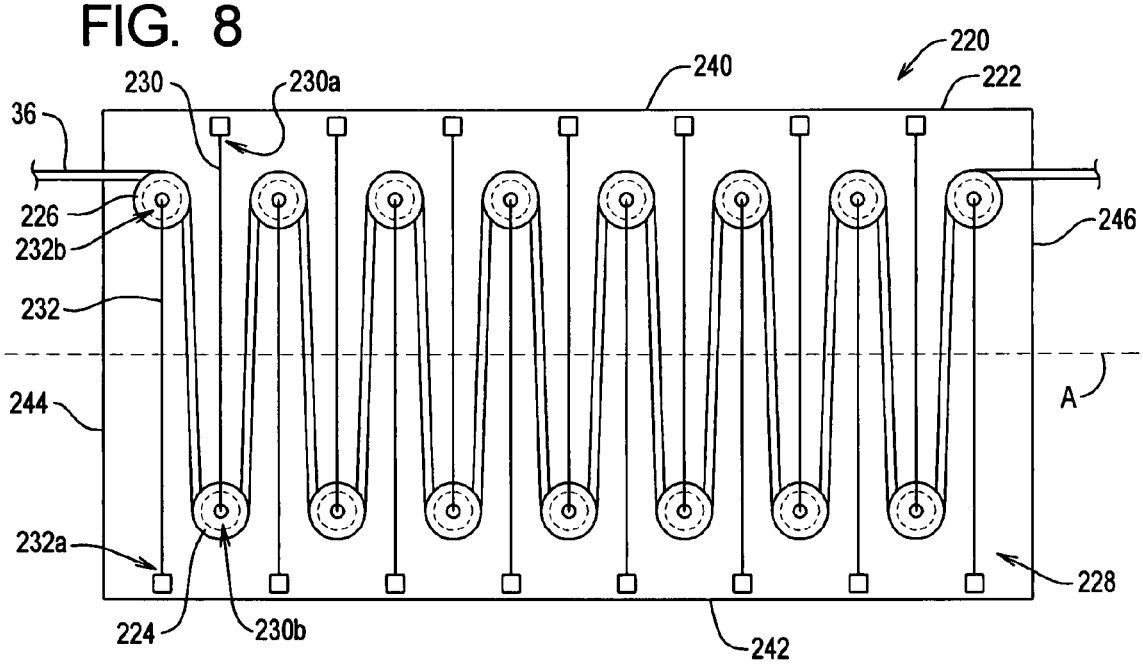

Referring now to FIGS. 6-8 of the drawing, depicted therein is a second example tensioning system 220 that may be used as the tensioning system 22 described above. The example tensioning system 220 comprises a frame 222, a first set of tensioning rollers 224, a second set of tensioning rollers 226, and a roller displacement system 228. The roller displacement system 228 comprises a first set of displacement assemblies 230 and a second set of displacement assemblies 232. Each of the displacement assemblies is connected between the frame 222 and one of the tensioning rollers 224 or 226.

In particular, the frame 222 comprises a first side edge portion 240, a second side edge portion 242, a first end edge portion 244, and a second end edge portion 246. The example tensioning system 220 defines a main axis A extending between the first and second end edge portions 244 and 246; the example main axis A is spaced parallel to and equidistant from the side edge portions 240 and 242.

A proximal end 230*a* of each of the first displacement assemblies 230 is connected to the first side edge portion 240. A proximal end 232*a* of each of the second displacement assemblies 232 is similarly connected to the second side edge portion 242. Distal ends 230*b* of the first displacement assemblies 230 are connected to a corresponding one of the first tensioning rollers 224, while distal ends 232*b* of the second displacement assemblies 232 are connected to a corresponding one of the second tensioning rollers 226.

The first displacement assemblies 230 are configured to displace the first tensioning rollers 224 towards and away from the first side edge portion 240. The second displacement assemblies 232 are similarly configured to displace the second tensioning rollers 226 towards and away from the second side edge portion 242. In addition, the first and second displacement assemblies 230 and 232 and the tensioning rollers 224 and 226 are offset from each other along the main axis A.

In use, the displacement assemblies 230 and 232 are initially configured as shown in FIG. 6 such that the tensioning rollers 224 and 226 are spaced in first positions on opposite sides of the main axis A; the line 36 is then arranged along the main axis A. The tension system 220 can thus be configured to obviate the need to thread the line 36 around the outer portions of the tensioning rollers 224 and 226.

The displacement assemblies 230 and 232 are then operated to displace the tensioning rollers 224 and 226 into a second position (FIG. 7) at which the tensioning rollers 224 and 226 engage the line 36. At this point, the line 36 extends along outer portions of the first and second tensioning rollers 224 and 226. The displacement assemblies 230 and 232 displace the tensioning rollers 224 and 226 such that these rollers move between the second position and a third position (FIG. 8) adjacent to the first and second edge portions 240 and 242, respectively.

As with the system 120 described above, effective lengths of the displacement assemblies 230 and 232 change as necessary to maintain any portion of the line 36 between the tensioning device 220 and the drum 32 at a predetermined tension load or within a desired range of tension loads. Also, the effective lengths of the displacement assemblies 230 and 232 may be changed using passive and/or active control systems as described above and depicted in FIGS. 4 and 5 or below with respect to FIGS. 11 and 12.

Referring now to 9 and 10 of the drawing, depicted therein is a third example tensioning system 320 that may be used as the tensioning system 32 described above. The example tensioning system 320 comprises a frame 322, a first set of tensioning rollers 324, a second set of tensioning rollers 326, and a roller displacement system 328. The roller displacement system 328 comprises one or more displacement assemblies 330 and a displacement structure 332. The second set of tensioning rollers 326 is supported by the displacement structure 332. The displacement assembly or assemblies 330 are connected between the frame 322 and displacement structure 332.

In particular, the frame 322 comprises a first side edge portion 340, a second side edge portion 342, a first end edge portion 344, and a second end edge portion 346. The example tensioning system 320 defines a main axis A extending between the first and second end edge portions 344 and 346;

the example main axis A is spaced parallel to and equidistant from the side edge portions 340 and 342.

The axes of the first tensioning rollers 324 are fixed relative to the first side edge portion 340. The axes of the second tensioning rollers 326 are fixed relative to the displacement structure 332. The displacement assembly or assemblies 330 are configured to displace the displacement structure 332 towards and away from the second side edge portion 342. The first and second tensioning rollers 324 and 326 are offset from each other along the main axis A.

Figure 9:
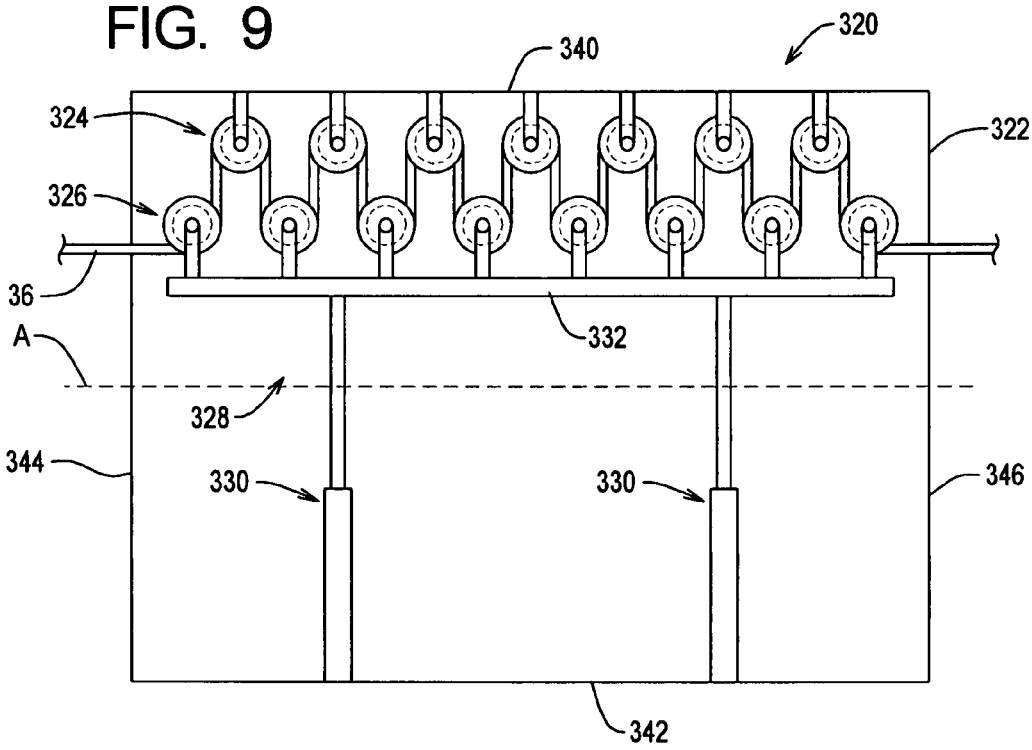
Figure 10:
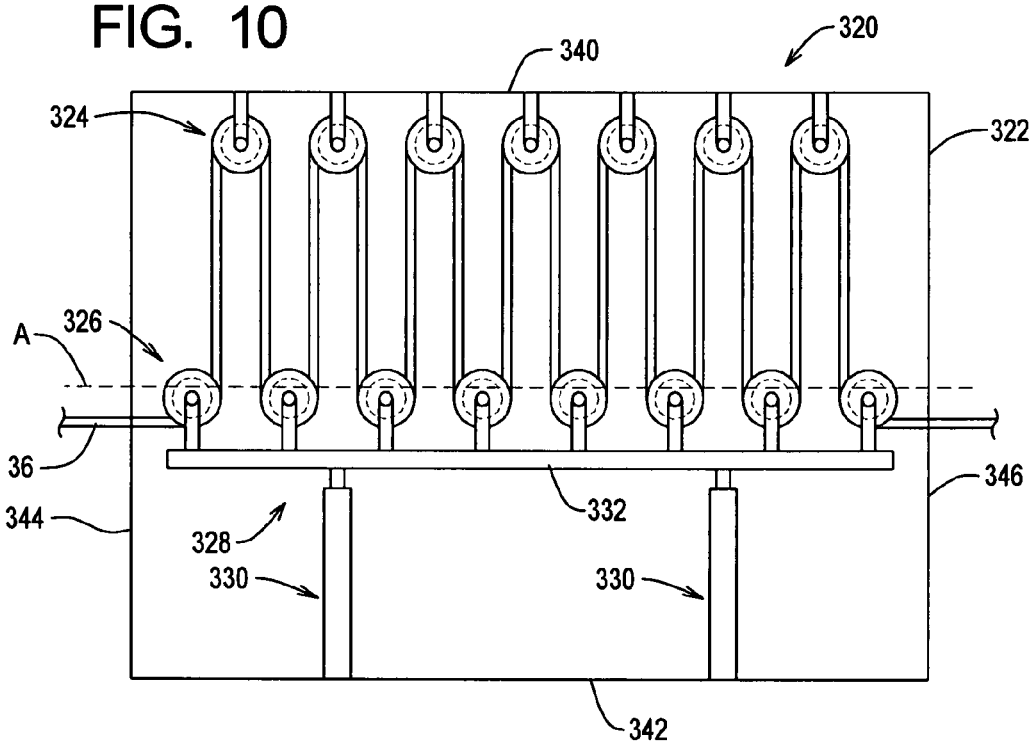

In use, the displacement assemblies 330 are initially configured as shown in FIG. 10 such that the tensioning rollers 324 and 326 are spaced in first positions relative to the main axis A; the line 36 is then arranged to extend around the outer edges of the rollers 324 and 326. The displacement assemblies 330 displace the tensioning rollers 326 such that these rollers move between a first position (FIG. 10) and a second position (FIG. 9), respectively.

As with the systems 120 and 220 described above, effective lengths of the displacement assemblies 330 change as necessary to maintain any portion of the line 36 between the tensioning device 320 and the drum 32 at a predetermined tension load or within a desired range of tension loads. Also, the effective lengths of the displacement assemblies 330 may be changed using passive and/or active control systems as described above and depicted in FIGS. 4 and 5 or below with respect to FIGS. 11 and 12.

Figure 11:
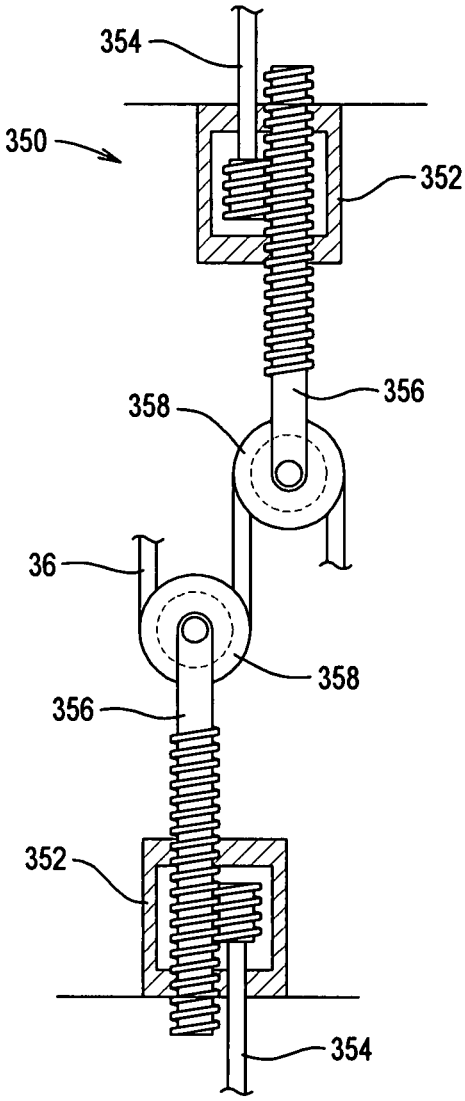

Referring now to FIG. 11 of the drawing, depicted therein is an example displacement assembly 350 that may be used as part of an active control system such as the active control system 150 described above. The displacement assembly 350 a housing 352, a drive shaft 354, and an extension shaft 356. The drive shaft 354 and extension shaft 356 are threaded and supported by the housing 352 such that rotation of the drive shaft 354 displaces the extension shaft 356 relative to the housing 352. By supporting tensioning rollers 358 on the extension shaft 356, the rollers 358 may be displaced as generally described above to control the tension on the line 36.

Figure 12:
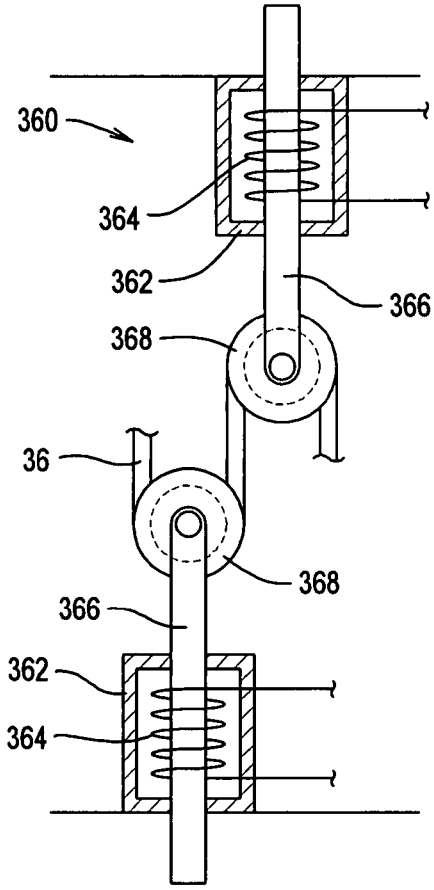

Referring now to FIG. 12 of the drawing, depicted therein is another example displacement assembly 360 that may be used as part of an active control system such as the active control system 150 described above. The displacement assembly 360 a housing 362, a drive coil 364, and an extension shaft 366. The drive coil 364 and extension shaft 366 are supported by the housing 362 such that application of a drive current to the coil 364 displaces the drive shaft 366 relative to the housing 362. By supporting tensioning rollers 368 on the extension shaft 366, the rollers 368 may be displaced as generally described above to control the tension on the line 36.

Given the foregoing, it should be apparent that the principles of the present invention may be embodied using forms other than those described above and depicted in the drawing. The scope of the present invention should thus be determined by the scope of the claims appended hereto and not the foregoing detailed description of the invention.

What is claimed is:

1. A line tensioning system for regulating tension on a line having a proximal end and a distal end, where the proximal end is operatively connected to a drum, the line tensioning system comprising:

a frame defining first and second side edges;

a first set of first rollers;

a first set of first displacement assemblies, where each first displacement assembly is arranged to displace at least one of the first rollers relative to the first side edge of the frame;

a second set of second rollers;

a second set of second displacement assemblies, where each second displacement assembly is arranged to displace at least one of the second rollers relative to the second side edge of the frame; whereby the line is arranged such that the line contacts the first and second rollers; and the first and second displacement assemblies displace the first and second rollers relative to the first and second edges based on a tension on the line.

2. A line tensioning system as recited in claim 1, in which each of the first and second displacement assemblies comprises an actuator assembly, where operation of the actuator assemblies displaces the first and second rollers relative to the frame.

3. A line tensioning system as recited in claim 2, further comprising an active control system, where the active control system operates the actuator assemblies based on the tension on the line.

4. A line tensioning system as recited in claim 1, in which the first and second displacement assemblies each comprise a spring member.

5. A line tensioning system as recited in claim 4, in which increased tension on the line compresses the spring members.

6. A line tensioning system as recited in claim 1, in which the frame defines a main axis, where the first rollers are offset from the second rollers along the main axis.

7. A line tensioning system as recited in claim 1, in which:

the first rollers move between first and second positions relative to the first edge portion; and the second rollers move between first and second positions relative to the second edge portion.

8. A line tensioning system as recited in claim 1, in which:

the first rollers move between first, second, and third positions relative to the first edge portion; and the second rollers move between first, second, and third positions relative to the second edge portion; and when the first and second rollers are in the first positions, the line may be arranged between the first and second rollers.

9. A system for placing a payload on a floor of a body of water, comprising:

a platform adapted to float on a surface of the body of water;

a drum supported by the platform;

a payout roller supported by the platform a line having a proximal end portion, an intermediate portion, and a distal end portion, where the proximal end portion of the line is operatively connected to the drum, a portion of the intermediate portion of the line extends over the payout roller, and a distal end of the line is detachably attached to the playload; and a tensioning system arranged between the drum and the payout roller, the tensioning system comprising a frame defining first and second side edges, a first set of first tensioning rollers, a first set of first displacement assemblies, where each first displacement assembly is arranged to displace at least one of the first tensioning rollers relative to the first side edge of the frame, a second set of second tensioning rollers, a second set of second displacement assemblies, where each second displacement assembly is arranged to displace at least one of the second tensioning rollers relative to the second side edge of the frame; whereby the line is arranged such that the line contacts the first and second tensioning rollers; and the first and second displacement assemblies displace the first and second tensioning rollers relative to the first and second edges based on a tension on the line.

10. A line tensioning system as recited in claim 9, in which each of the first and second displacement assemblies comprises an actuator assembly, where operation of the actuator assemblies displaces the first and second tensioning rollers relative to the frame.

11. A line tensioning system as recited in claim 10, further comprising an active control system, where the active control system operates the actuator assemblies based on the tension on the line.

12. A line tensioning system as recited in claim 9, in which the first and second displacement assemblies each comprise a spring member.

13. A line tensioning system as recited in claim 12, in which increased tension on the line compresses the spring members.

14. A line tensioning system as recited in claim 9, in which the frame defines a main axis, where the first tensioning rollers are offset from the second tensioning rollers along the main axis.

15. A line tensioning system as recited in claim 9, in which:

the first tensioning rollers move between first and second positions relative to the first edge portion; and the second tensioning rollers move between first and second positions relative to the second edge portion.

16. A line tensioning system as recited in claim 9, in which:

the first tensioning rollers move between first, second, and third positions relative to the first edge portion; and the second tensioning rollers move between first, second, and third positions relative to the second edge portion; and when the first and second tensioning rollers are in the first positions, the line may be arranged between the first and second tensioning rollers.

17. A method of regulating tension on a line having a proximal end and a distal end, where the proximal end is operatively connected to a drum, the method comprising the steps of:

displacing at least one first roller relative to a first side edge of a frame;

displacing at least one second rollers relative to a second side edge of the frame;

arranging the line such that the line contacts the first and second rollers; and operating the first and second displacement assemblies to displace the first and second rollers relative to the first and second edges based on a tension on the line.

18. A method as recited in claim 17, in which the frame defines a main axis, where the first rollers are offset from the second rollers along the main axis.

19. A method as recited in claim 17, in which:

the first rollers move between first and second positions relative to the first edge portion; and the second rollers move between first and second positions relative to the second edge portion.

20. A method as recited in claim 17, in which:

the first rollers move between first, second, and third positions relative to the first edge portion; and the second rollers move between first, second, and third positions relative to the second edge portion; and when the first and second rollers are in the first positions, the line may be arranged between the first and second rollers.

* * * * *